US005842892A

United States Patent [19]

Heimueller et al.

[11] Patent Number: 5,842,892

[45] Date of Patent: Dec. 1, 1998

[54] PLUG CONNECTOR

[75] Inventors: Hans-Jost Heimueller, Dudenhofen; Martin Straeb, Hassloch; Michael Gib, Landau; Miroslav Smoravek, Seefeld, all of Germany; Rony Van Houdenhove, Ruiselede, Belgium

[73] Assignee: Siemens Aktiengesellschaft, Munich, Germany

[21] Appl. No.: 691,186

[22] Filed: Aug. 1, 1996

[30] Foreign Application Priority Data

Aug. 1, 1995 [DE] Germany ..... 195 28 236.1

[51] Int. Cl.[6] ..... H01R 13/436

[52] U.S. Cl. ..... 439/752

[58] Field of Search ..... 439/752, 595

[56] References Cited

U.S. PATENT DOCUMENTS

| | | | |
|---|---|---|---|
| 5,116,236 | 5/1992 | Colleran et al. | 439/752 |
| 5,145,356 | 9/1992 | Minnis | 439/352 |
| 5,199,902 | 4/1993 | Kahle et al. | 439/752 |
| 5,252,095 | 10/1993 | Breitschaft et al. | 439/752 |
| 5,573,432 | 11/1996 | Hatagishi | 439/752 |
| 5,586,918 | 12/1996 | Chemin | 439/752 |

FOREIGN PATENT DOCUMENTS

| | | | |
|---|---|---|---|
| 0 592 102 | 4/1994 | European Pat. Off. . | |
| 3537722 | 4/1987 | Germany | 439/752 |

*Primary Examiner*—Gary F. Paumen
*Attorney, Agent, or Firm*—Herbert L. Lerner; Laurence A. Greenberg

[57] ABSTRACT

A lockable plug connector includes a prong strip housing which contains prong contacts and onto which a multichambered bush housing with bush contacts, connected to electric lines, can be plugged and locked by a snap connection, so that the prong contacts are put into electrical contact with the bush contacts. For the sake of attaining a very compact structure, a cover cap is thrust onto the plug contact side of the bush housing, and with this cap a secondary securing of the bush contacts is achieved. An annular wall of the prong strip housing fits over the cover cap completely and terminates at an end surface in an encompassing recess of the bush housing. For sealing purposes, a sealing plate can be disposed inside the bush housing, a sealing ring can be disposed between the prong strip housing and the bush housing, and a sealing ring encompassing the outer wall of the prong strip housing can be provided.

12 Claims, 4 Drawing Sheets

PLUG CONNECTOR

BACKGROUND OF THE INVENTION

1. Field of the Invention

The invention relates to a plug connector having a prong strip housing containing prong contacts, onto which housing a multi-chambered socket housing can be plugged by socket contacts that are connected to electrical lines and can be locked through the use of a snap-type connection, so that the prong contacts are put into electrical contact with the socket contacts.

One such plug connector is described, for instance, in Published European Patent Application 0 592 102 A2. The complete plug connector substantially includes a prong strip housing, with an annular wall, inside which many prong contacts are disposed. Those prong contacts are put into contact with a corresponding plug in which there are many socket contacts, for instance so-called spring contacts. The socket contacts are disposed inside their own socket housing, and the socket housing is constructed in multiple parts. The socket housing has a rear cap part, an intermediate part and a front part. A sealing plate is mounted between the rear part and the front part for sealing purposes. The entire socket housing is mounted by axially plugging together the various components. The rear part, the intermediate part, and the front part are held together through the use of snap connections.

A problematic aspect of that known structure is the relatively complicated construction and the axial plugging together of the various components of the socket housing, which makes snap connections acting in the plugging direction unreliable. Moreover, it cannot be learned from the aforementioned reference how the individual socket contacts are locked in the chambers of the socket housing, so as to be effectively secured against being pulled out of the socket housing.

SUMMARY OF THE INVENTION

It is accordingly an object of the invention to provide a lockable plug connector, which overcomes the hereinaforementioned disadvantages of the heretofore-known devices of this general type, which is distinguished by an extremely compact structure, which enables effective securing of socket contacts inside a socket housing and which can be constructed as needed to be water tight merely by the additional introduction of sealing elements, without being structurally modified.

With the foregoing and other objects in view there is provided, in accordance with the invention, a plug connector, comprising a prong strip housing containing prong contacts; a multichambered socket housing having a plug contact side, electrical lines, socket contacts connected to the electrical lines for plugging the plug contact side of the socket housing onto the prong strip housing in a given plug-in direction, and detent elements for securing the socket contacts inside the socket housing; a cover cap to be fitted and thrust onto the plug contact side of the socket housing orthogonally to the given plug-in direction, the cover cap having a contact region with openings formed therein; the prong strip housing having an annular wall to be fitted completely over the cover cap, the annular wall having an end surface to be disposed in an encompassing recess formed in the socket housing; and a snap-type connection having at least one outer hook on the prong strip housing and at least one opening formed in the socket housing, for locking the socket housing onto the prong strip housing and placing the prong contacts into electrical contact with the socket contacts.

Such a plug connector is distinguished by a relatively small structure. Thanks to the snap connections which are provided it is securely lockable and thanks to the cover cap having the detent elements provided there and being thrust orthogonally to the plugging direction onto the socket housing, the socket contacts along with the lines connected to them are secured against being pulled out of the socket housing unintentionally. Unintentional pulling out of the lines or loosening of the plug connection is impossible, or is possible only with an extreme exertion of force, so that the plug connector of the invention is excellently well suited for use as an electrical coupling in automotive technology. Finally, the plug connector of the invention, without having to be structurally modified, can be made water-tight and dust-tight by the addition of sealing elements, especially a sealing plate and two sealing rings.

In accordance with another feature of the invention, the socket housing, on one of its broad sides, is provided approximately centrally with a detent lever having an opening, the detent lever fitting over the wall of the prong strip housing in such a way that the snap hook of the prong strip housing is snapped into the opening. The snap connection and the locking thus attained for the socket housing to the prong strip housing and therefore to the plug part and socket part of the plug connector can be attained by pressing, with a predetermined force, against the end of the detent lever opposite the snap connection. As a result, the detent lever is easily lifted above the snap hook of the socket housing, and the prong strip housing or socket housing can then be pulled off. The leverage required therefor is suitably dimensioned in such a way that excessive expansion of a hinge, which is preferably made of plastic, by way of which the detent lever is secured to the socket housing, is possible. Preferably, there is one rib on each of the two sides of the detent lever that prevents possible jamming of the lines beneath the detent lever.

In accordance with a further feature of the invention, the detent lever fits over the annular wall of the prong strip housing to approximately half its length. As a result, a relatively long detent lever is furnished, which on the end opposite the snap connection requires only slight leverage to undo the snap connection.

In accordance with an added feature of the invention, the socket housing can be covered on its side remote from the plug-in side by a lid, and the lid is snapped onto the socket housing through the use of a snap connection.

In accordance with still another feature of the invention, the lid and the socket housing are adapted to one another, and are provided with openings and detent hooks, in such a way that the lid can be snapped onto the socket housing both in a first position and in a second position rotated 180° from it.

By simply rotating the lid, which has an opening on the side for passing a cable through it, the cable outlet of the plug connector can thus be provided on either the left or the right side. This furnishes a high degree of flexibility for the plug connector of the invention. Moreover, such a plug connector is easy to manufacture, because regardless of whether the cable outlet is to be placed to the left or the right of the plug connector, only a single injection mold is necessary for the socket housing and the associated lid.

In accordance with an additional feature of the invention, there is provided a retention plate to be inserted into the socket housing on the side remote from the plug-in side, the retention plate having openings through which the electric lines for the socket contacts can be inserted into the socket housing on the side remote from the plug-in side. This retaining plate acts as a guide for the lines and keeps them spaced apart, due to the openings which are provided.

In accordance with yet another feature of the invention, the cover cap of the plug connector has a T-shaped rib engaging between resilient inner walls of the socket housing, and a T-shaped end piece of the rib engages edges of the socket contact from behind. The T-shaped end piece of the rib forms an independent secondary securing device for the socket contacts inserted into the socket housing. The T-shaped rib of the cover cap secures the socket contacts of two adjacent rows of chambers inside the socket housing.

In accordance with yet a further feature of the invention, the socket housing has chambers located side by side in three rows, and in the middle row and one outer row the socket contacts are rotated by 180° from one another. In the remaining third row, short-circuit bridges for short-circuiting the adjacent socket contacts may be provided. The aforementioned T-shaped rib of the cover cap secures the socket contacts of the middle chamber and the socket contacts of the adjacent outer chamber.

In accordance with yet an added feature of the invention, the prong strip housing is provided, on the side remote from the plug-in side, with protrusions of various lengths on which the prong contacts at least partially rest, the prong contacts being bent 90° in the same direction at the end of the protrusions. This provision allows simple installation of the plug prongs in the prong strip housing. The prong contacts rest on the protrusions and are thus effectively protected against damage.

The plug connector described thus far can easily be constructed to be dustproof and waterproof by placing a plurality of sealing elements inside the plug connector.

In accordance with yet an additional feature of the invention, the socket housing is provided with a sealing plate, through which the lines for the socket contacts are guided.

In accordance with again another feature of the invention, there is provided a sealing ring disposed in the end-surface extension of the walls of the cover cap, the sealing ring being disposed between the annular wall of the prong strip housing and an encompassing wall of the socket housing. The sealing plate performs the function of sealing off both the lines to which the socket contacts are connected and the individual chambers of the socket housing.

In accordance with again a further feature of the invention, the prong contacts are guided water-tightly through the prong strip housing, for instance by press-fitting the prong contacts into the prong strip housing or spray-coating them after installation.

In accordance with a concomitant feature of the invention, in order to enable mounting the prong strip housing in water-tight fashion, the outer wall of the prong strip housing is provided with an annular groove in which a further sealing ring is disposed.

Other features which are considered as characteristic for the invention are set forth in the appended claims.

Although the invention is illustrated and described herein as embodied in a plug connector, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
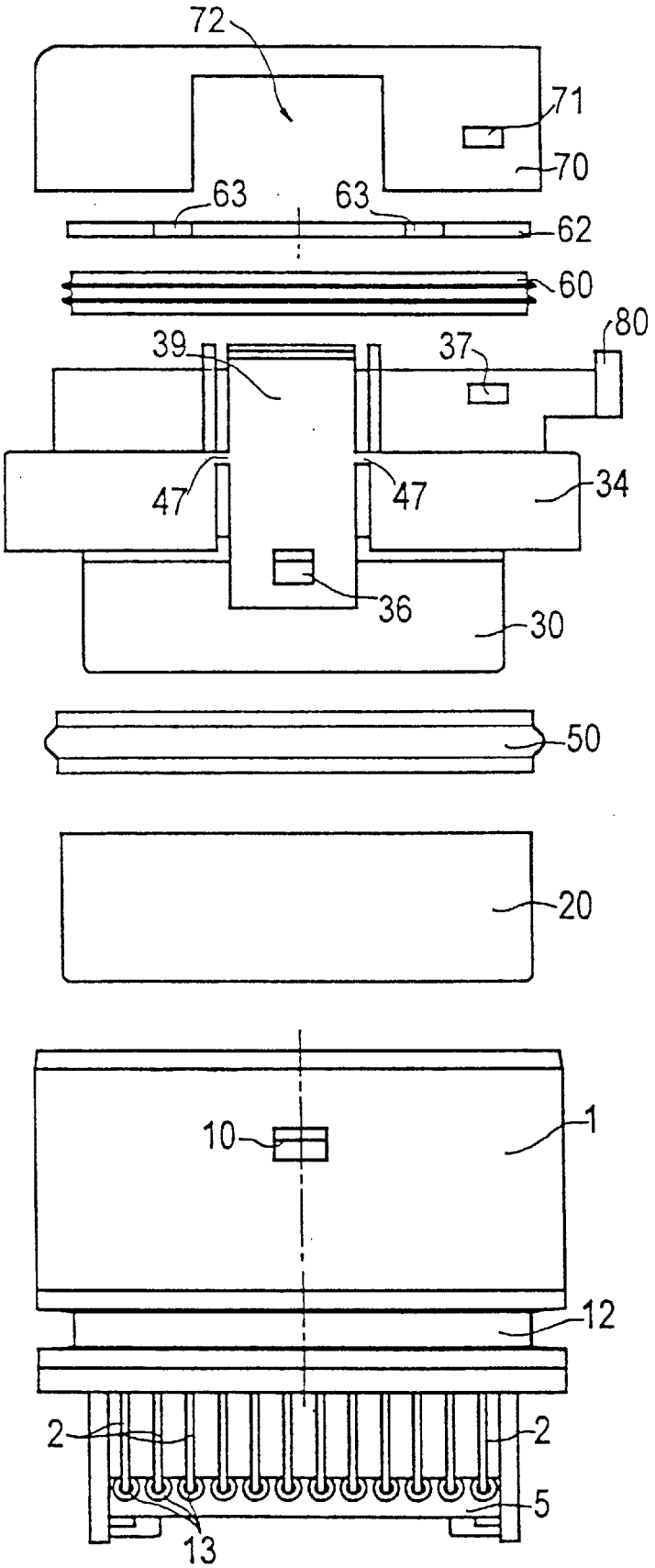
FIG. 1 is a diagrammatic, exploded, plan view of various components of a plug connector of the invention.

Referring now in detail to the figures of the drawings, in which the same reference numerals identify the same parts with the same meaning unless otherwise stated and first, particularly, to FIG. 1 thereof, there is seen a plan view of an exemplary embodiment of a plug connector of the invention, in which individual components of the plug connector have been disassembled and lie one above the other. The plug connector has a prong strip housing 1, acting as a plug part, that includes an annular wall having an interior in which many prong contacts that are not visible in FIG. 1, are disposed. A broad side of the wall of the prong strip housing 1 facing toward the observer in FIG. 1 is provided with a snap hook 10 to be described below. This snap hook 10 is seated approximately centrally halfway across the width of the prong strip housing 1. Many prong contacts 2 protrude from an end of the prong strip housing 1 remote from the plug-in side. The prong contacts 2 are disposed parallel to one another and are each bent into the plane of the drawing in the same direction by 90° on their lower end. The ends of these prong contacts 2 protrude through corresponding openings 13 in a guide 5 that is preferably made of insulating material, such as ceramic or ferrite material. Although this guide is not absolutely necessary for the mechanical construction of the plug connector, nevertheless it is advantageous for the sake of electromagnetically shielding it. The prong contacts 2 may be soldered at their ends, for instance to a printed circuit board of an electrical circuit configuration, although this is not visible in FIG. 1. The prong strip housing 1 is also provided with an annular groove in which a sealing ring 12 is disposed.

The bush part of the plug connector shown in FIG. 1 substantially includes a socket housing 30, over which a cover cap 20 is fitted on its side facing toward the plug-in end, as well as a lid 70 which is snapped onto the socket housing 30 on the opposite end. A retaining plate 62 which is described in further detail with regard to the subsequent drawing figures and which is provided with openings 63 for the passage of electrical lines, is disposed between the lid 70 and the socket housing 30. A sealing plate 60 preferably rests on the broad side of the retaining plate 62 facing toward the socket housing 30, in order to make the plug connector water tight.

A sealing ring 50 is provided in order to enable a sealing insertion of the further socket part, including the lid 70, the socket housing 30 and the cover cap 20 of the cap according to the invention, into the prong strip housing 1. The sealing ring 50 is thrust over the lower portion of the socket housing 30 facing toward the plug-in side, specifically far enough to ensure that the lower portion of the socket housing 30 protrudes out of the sealing ring 50. Next, the cover cap 20 is thrust onto this protruding lower portion of the socket housing 30, orthogonally to the plugging direction of the plug connector.

The broad side of the socket housing 30 facing toward the observer in FIG. 1 has a detent lever 39, extending centrally along the plugging direction of the plug connector and being provided with an opening 36 approximately centrally in its end facing toward the plug-in side. The detent lever 39 is approximately one-fourth as wide as the entire width of the socket housing 30 and is joined to an encompassing collar 34 of the socket housing 30 through two integral webs 47. The detent lever 39 can be pivoted about these webs 47 in response to pressure exerted on the end of the detent lever 39 which is remote from the plug-in side. As a result, the detent lever 39 is lifted by its end facing toward the plug-in side, so that when the plug connector is put together, the opening 36 is lifted away from the snap hook 10 of the prong strip housing 1.

In addition, in the part of the socket housing 30 remote from the plug-in side, there is a further detent hook 37, which cooperates with an associated opening 71 in the lid 70 to form a snap connection. On the far broad side of the socket housing 30, in terms of the view of FIG. 1, there is also a detent hook 37, which cooperates as a snap connection with another corresponding opening in the lid 70, so that the plug connector of the invention can be constructed with a cable outlet 80 on either the left or the right.

As FIG. 1 also shows, the lid 70 is provided with a central U-shaped cutout 72, so that the lid 70 can be snapped onto the socket housing 30 without covering the detent lever 39 of the socket housing 30.

Figure 2:
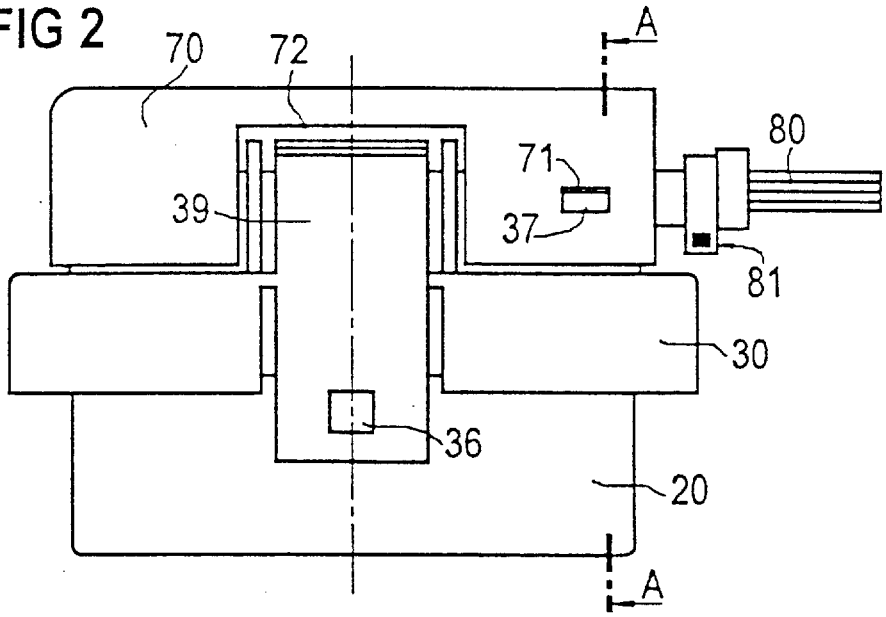
FIG. 2 is a plan view of a socket part of the plug connector of the invention with a socket housing, a cover cap thrust onto the socket housing and a snapped-on lid plate.

The mounted socket part of the plug connector presented in FIG. 1 is shown in FIG. 2. The snapping of the detent hook 37 into the associated opening 71 in the lid 70 is clearly apparent. It is also clear that the lid 70 does not cover the detent hook 39, because of its U-shaped cutout 72. With the prior slipping on of the sealing ring 50 presented in FIG. 1, the cover cap 20 is shown thrust onto the socket housing 30, specifically onto the lower portion of the socket housing 30.

In the exemplary embodiment of FIG. 2, the socket part has a cable outlet 80 on its right-hand side. This cable outlet 80 also has a cable fixation 81, through which various lines of the cable outlet 80 are retained.

Figure 3:
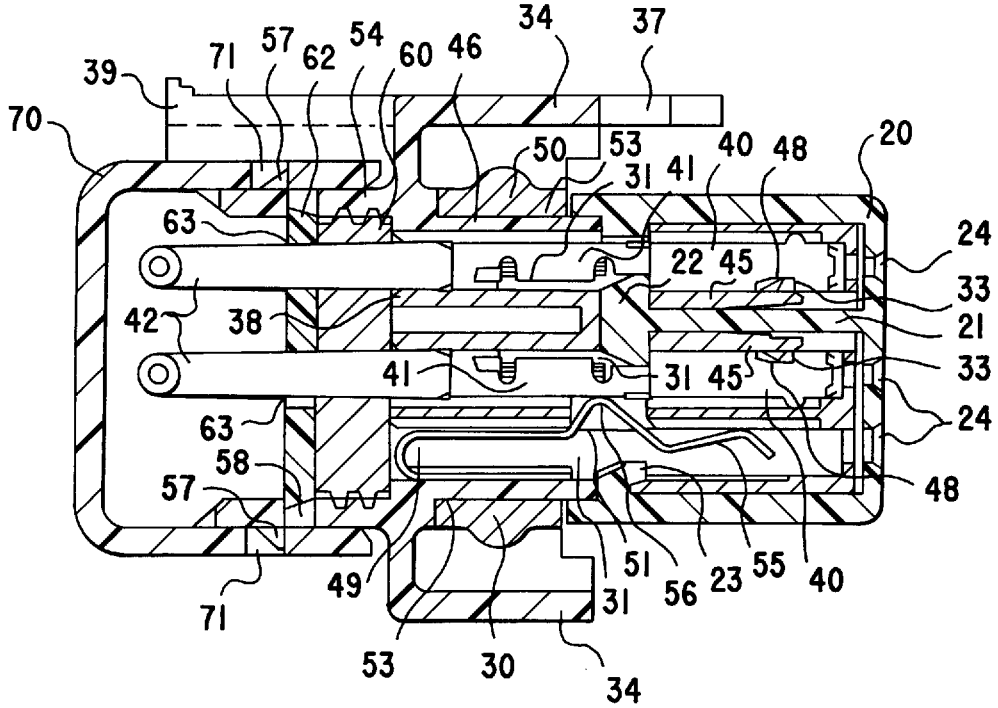
FIG. 3 is a sectional view of the socket part which is taken along a section line A—A of FIG. 2, in the direction of the arrows.

FIG. 3 shows the socket part shown in FIG. 2 in a sectional view along a line A—A of FIG. 2. Those reference numerals which were already mentioned stand for the same elements once again. As can be seen, the socket part includes a multichambered socket housing 30, which in the present exemplary embodiment has three rows of chambers 31. The individual rows of chambers 31 are disposed parallel to one another. A socket contact 40, for instance a contact spring, is inserted into the chamber 31 shown uppermost in FIG. 3 and it can be contacted by a prong contact 2 of the prong strip housing 1 through an opening in an end. The socket contact 40 is connected through a contact zone 41 to an electrical line 42. A similar socket contact 40 with a contact zone 41 and a connected electrical line 42 is located in the middle chamber 31 of the socket housing 30. The two socket contacts 40 are rotated through 180° relative to one another. The socket contacts 40 have recesses 48 pointing toward one another, which are engaged for primary locking purposes by detent hooks 33 of resilient inner walls 45 of the socket housing 30. These detent hooks 33 form a primary securing device for the socket contacts 40. A short-circuit bridge 55, which is known per se, is inserted into the lowermost chamber 31 of the socket housing 30. Adjacent socket contacts 40 are short-circuited by this bridge for safety reasons with the plug connector in the noninstalled state, in other words when the plug part is not mounted on the socket part. This short-circuiting is shown in FIG. 3 by a recess 56 of the short-circuit bridge 55 that contacts the contact zone 41 of the middle socket contact 40. To that end, a partition 49 of the socket housing 30, which is provided with an opening 51 in the region of the recess 56 of the short circuit bridge 55, is inserted between the lower contact chamber 31 and the middle chamber 31.

In order to provide secondary securing of the short-circuit bridge 50 and the socket contacts 40, according to the invention a cover cap 20 with a cup-shaped outer contour is fitted over the portion of the socket housing 30 facing toward the plug-in side. This is carried out by slipping the cover cap 20, orthogonally to the plugging direction, onto the portion of the socket housing 30 shown on the right in FIG. 3. The cover cap 20 has openings 24, which in the mounted state are aligned with the openings in the socket housing 30, on its end surface facing toward the plug-in side. The outer walls of the cover cap 20, which are fitted over the socket housing 30, are provided with secondary hooks 23, which extend into the interior of the socket housing through openings provided in the socket housing. With the cover cap 20 thrust into place, any attempt at separating the cover cap 20 from the socket housing 30 in the plugging direction is precluded. The cover cap 20 is also provided with a T-shaped rib 21, which thrusts between the resilient inner walls 45 of the socket housing 30 and forms a hook 22 with its T-shaped end, that engages the back side of contours of the upper socket contact 40 and the lower socket contact 40. The T-shaped rib 21 has its lengthwise leg shaped in such a way that the resilient inner walls 45, with their detent hooks disposed on the distal end, can engage the aforementioned openings 48 in the socket contacts 40. These detent hooks 33 serve the purpose of primary locking of the socket contacts 40.

The securing of the socket contacts 40 inside the chambers 31 of the socket housing 30 is thus effected in three ways. The primary securing of the socket contacts 40 is brought about by the elastic rearward swiveling of the resilient inner walls 45 of the socket housing 30. In a release test, in which the force that the primary locking device withstands is determined, the corresponding test would be carried out without the cover cap 20.

Slipping the cover cap 20 on orthogonally, on one hand then mechanically tests whether or not all of the resilient inner walls 45 have swiveled back (dependent secondary securing or "backup securing"), and on the other hand whether or not an independent secondary securing device is furnished by the T-shaped end piece of the rib 21 of the cover cap 20.

The cover cap 20 is intentionally not constructed in such a way that it presses the resilient primary detent hooks 33 into the socket contacts 40. If a primary detent hook 33 does not resiliently deflect on its own into the recess of a socket contact 40, then this is due to the fact among others that the socket contact 40 is not plugged in all the way. This defect should be noted, from among other factors, because the cover cap 20 cannot be thrust into place without using force.

As FIG. 3 shows, the socket housing 30 has an L-shaped collar 34, which is integrally formed onto a wall 46 of the socket housing 30 and extends around the socket housing 30. This collar 34 of L-shaped cross section is located approximately at the level of the transition from the contact zone 41 to the lines 42, in that there a wall portion springing orthogonally away from the outer wall of the socket housing 30 adjoins the wall 46 and then terminates in a straight portion that springs back again in the direction of the plug-in side of the plug connector. This produces a U-shaped recess extending around the outside of the socket housing, which is engaged, as will be explained below, by the annular wall of the prong strip housing 1 when the plug connector is assembled.

The inner wall portion 46 facing the collar 34 of the socket housing 30 has an L-shaped recess 53, in which the sealing ring 50 shown in FIG. 1 is placed. This sealing ring 50 rests with its inner annular surface flatly on the outside of the L-shaped recessed wall 46 of the socket housing 30. The sealing ring 50 also rests with its end surface shown on the left in FIG. 3 on the L-shaped wall 46. A recess of pouchlike cross section is disposed on the outer annular surface of the sealing ring 50 toward a collar 34 of the socket housing 30. As will also be explained in conjunction with FIG. 5, this recess rests on the prong strip housing 1 for sealing purposes. An end surface of the sealing ring 50 has a height that is approximately equivalent to the height of the L-shaped recess of the wall 46 of the socket housing 30. As can also be seen from FIG. 3, the sealing ring 50 is bounded on its right-hand end by the end-surface wall of the cover cap 20. The L-shaped wall 46 of the socket housing, together with the end-surface wall of the cover cap 20, forms a U-shaped recess, in which the sealing ring 50 can be placed and adjusted in a simple manner.

As can also be seen from FIG. 3, the socket housing 30, in the axial extension of the rib 21, has a wall 38 of U-shaped cross section that defines the chambers 31 through the socket contacts 40.

The socket housing 30 is also provided with an annular wall 54, which extends onward approximately along the wall 46 of the socket housing 30, in the opposite direction of the plugging direction, and is provided with openings 58 in order to receive a retaining plate 62. The retaining plate 62 likewise has openings 63, to allow the lines 42 for the socket contacts 40 to pass through.

The surface of the retaining plate 62 facing toward the plug-in side has a sealing plate 60 contacting it. This plate serves to seal off the line 42 and the chambers 31 of the socket housing 30. The sealing plate 60 is formed of some suitable flexible plastic material and preferably has a plurality of ribs, in this case two of them, on its annularly encompassing outer surface. For assembly reasons, the annular wall 54 is recessed inward in an L-shape in the region of the sealing plate 60, so that the sealing plate 60 can be seated in this recess.

On the side of the annular wall 54 of the socket housing 30 remote from the plug-in side, detent hooks 37 are formed integrally onto the outside. These detent hooks 37 cooperate with openings 71 in the lid 70, so that the lid 70 can be snapped onto the socket housing 30. The detent hooks 37 and openings 71 are constructed in such a way that the lid 70 can also be snapped, rotated 180°, onto the socket housing 30.

As can also be seen from FIG. 3, the socket housing is provided with the detent lever 39 that was already mentioned above and which extends in both directions through the collar 34 of the socket housing 30. The detent hook 37 that was also already mentioned above for detent-locking retention of the prong strip housing 1 can also be seen.

Figure 4:
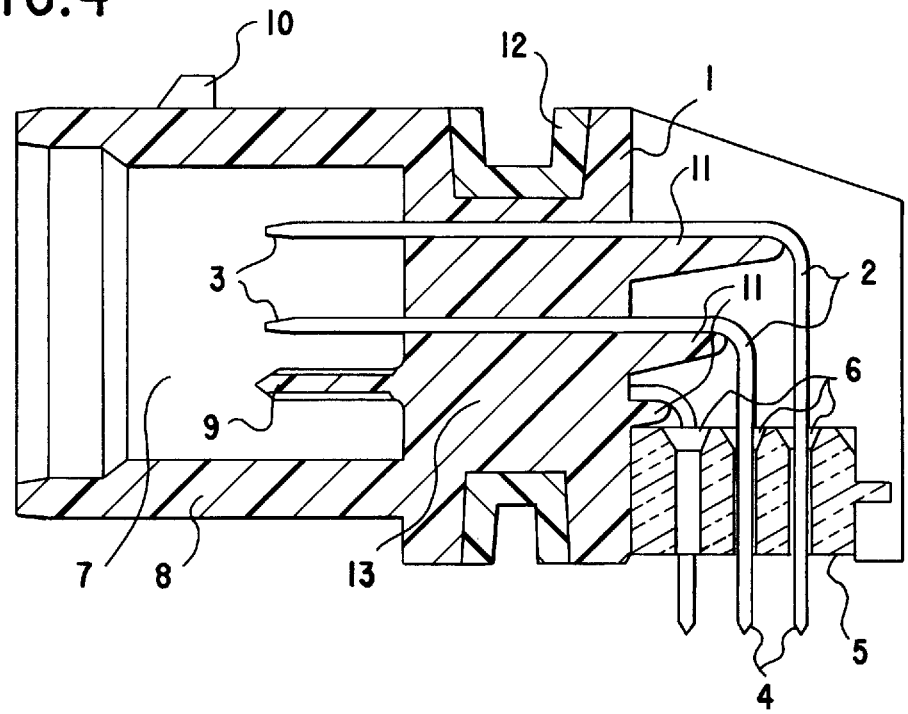
FIG. 4 is a sectional view of a prong strip housing, with prong contacts inserted.

FIG. 4 shows a sectional view through the prong strip housing 1. The prong strip housing 1 has a platelike bottom 13, from which cup-shaped walls 8 extend away on one surface. This forms a hollow chamber 7 that is open toward the plug-in side, into which chamber the prong contacts 2 protrude with prong contact tips 3. A plug-in body 9 which also protrudes into this plug-in chamber 7 is integrally formed onto the bottom 13 of the prong strip housing 1 and is used to undo the short-circuited connection made with the socket contacts by the short-circuit bridge seen in FIG. 3.

The snap hook 10 which is intended for snap connection with 25 the socket housing 30 is provided on the outside of the cup-shaped wall 8.

The prong contacts 2 are preferably guided in water-tight fashion through the bottom 13 of the prong strip housing 1. This can be carried out, for instance, by press-fitting the prong contacts 2 in place or by spray-coating or plastic sheathing of the prong contacts 2. The bottom 13 has a side remote from the plug-in chamber 7 including three protrusions 11 of various lengths with an upper surface, as seen in FIG. 4, that serves to guide the prong contacts 2. The prong contacts 2 rest flatly on these protrusions 11 and then at the ends of the protrusions 11 are each bent 90° in the same direction, in this case downward. The protrusions 11 are constructed to be precisely long enough to ensure that the prong contacts bent by 90° come to rest alongside one another and can be guided through bores of a guide, preferably a ceramic or ferrite guide 5.

The annular groove in the prong strip housing 1, in which a sealing ring 12 is placed, is also visible in FIG. 4.

Figure 5:
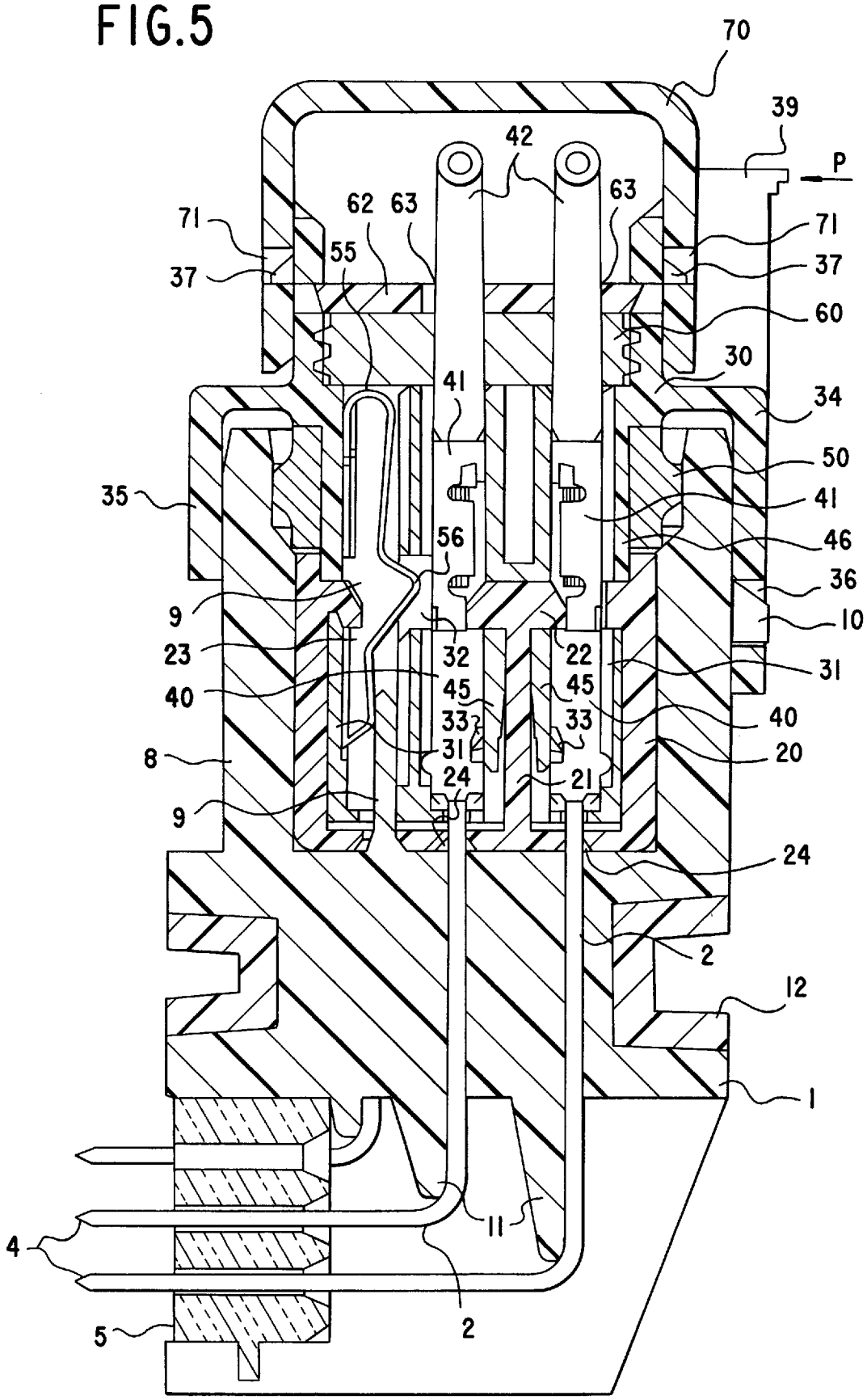
FIG. 5 is a sectional view of the complete plug connector of FIGS. 1–4 in an assembled state.

FIG. 5 shows the plug connector described above in the assembled state. The prong strip housing 1 is inserted, together with the prong contacts 2 contained therein, into the socket housing 30. The snap hook 10 comes to rest in the opening 36 of the detent lever 9 and thus assures a secure connection of the prong strip housing 1 and the socket housing 30. This snap connection can be undone simply by pressing lightly on the end region of the detent lever 39 identified by reference symbol P.

The function of the plug-in body 9 can also be seen. The plug-in body 9 of the prong strip housing 1 engages the short-circuit bridge 55 from behind and lifts the recess 56 thereof away from the contact zone 41 of the socket contact 40, thus un-doing the short circuit.

It can also clearly be seen in FIG. 5 that the front part of the cup-shaped wall 8 of the prong strip housing 1 engages the interstice of the socket housing formed by the wall 46 and the collar 34 of the socket housing 30 and presses the ring seal 50 in the radial direction at the recess provided there.

The plug connector of the invention is preferable for use as a plug connector in automotive engineering, since it excels in being very small in structure, securely lockable, and waterproof because of the use of the aforementioned sealing elements. Moreover, the plug connector of the invention is provided by dual contact locking, namely a primary locking and a secondary locking, which function independently of one another.

Figure 6:
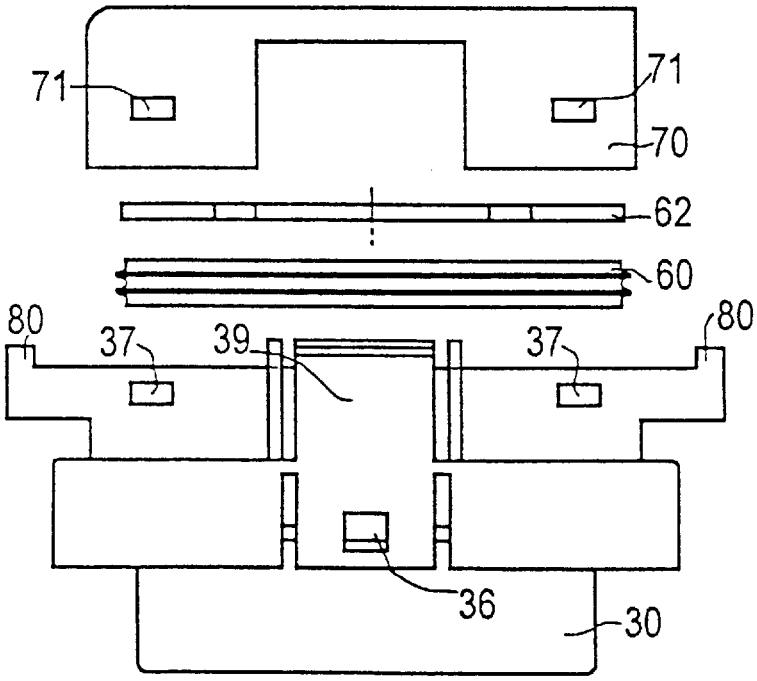
FIG. 6 is a view like FIG. 1 of a further plug connector.

For the sake of completeness, FIG. 6 also shows a further exemplary embodiment of a plug connector according to the invention. The structure is largely equivalent to that of FIG. 1.

However, unlike the embodiment of FIG. 1, the lid 70 has two openings 71. The socket housing 30 is again provided with two detent hooks 37, which cooperate with the aforementioned openings 71 in the cover cap 70, that are located on either side to the left and right of the detent lever 39. Finally, this socket housing 30 is provided both on the right and the left with a formed-on tubular extension acting as a cable outlet 80, so that a 180°-rotated construction of the plug connector is readily possible.

We claim:

1. A plug connector, comprising:

a prong strip housing containing prong contacts;

a multichambered socket housing having a plug contact side, electrical lines, contacts having edges connected to said electrical lines for plugging said plug contact side of said socket housing onto said prong strip housing in a given plug-in direction, resilient inner walls with distal detent hooks, and detent elements for securing said contacts inside said socket housing;

a cup-shaped cover cap to be fitted and thrust onto said plug contact side of said socket housing orthogonally to said given plug-in direction, said cover cap having a contact region with openings formed therein;

said cover cap having a T-shaped rib engaging between said resilient inner walls and pressing said resilient inner walls into recesses formed in said contacts for primary locking, and said rib having a T-shaped end piece engaging from behind said edges of said contacts;

said prong strip housing having an annular wall to be fitted completely over said cover cap, said annular wall having an end surface to be disposed in an encompassing recess formed in said socket housing; and a snap-type connection having at least one outer hook on said prong strip housing and at least one opening formed in said socket housing, for locking said socket housing onto said prong strip housing and placing said prong contacts into electrical contact with said contacts.

2. The plug connector according to claim 1, wherein said socket housing has broad sides and a detent lever being disposed approximately centrally on one of said broad sides, said opening in said socket housing is formed in said detent lever, and said detent lever fits over said wall of said prong strip housing with said snap hook of said prong strip housing snapping into said opening in said detent lever.

3. The plug connector according to claim 2, wherein said detent lever fits over approximately half of the length of said annular wall of said prong strip housing.

4. The plug connector according to claim 1, wherein said socket housing has another side remote from said plug contact side, and including a lid covering said other side of said socket housing and being snapped onto said socket housing by a snap connection.

5. The plug connector according to claim 1, wherein said socket housing has another side remote from said plug contact side, and including a retention plate fastened into said socket housing on said other side, said retention plate having openings formed therein through which said electric lines for said contacts are inserted.

6. The plug connector according to claim 1, wherein said multichambered socket housing has chambers located side by side in a middle and two outer rows, said contacts are rotated through 180° from one another in said middle row and one of said outer rows, and the other of said outer rows has short-circuit bridges for short-circuiting said adjacent contacts.

7. The plug connector according to claim 1, wherein said prong strip housing has a plug-in side, another side remote from said plug-in side, and protrusions of various lengths being disposed on said other side and having ends, said prong contacts at least partially resting on said protrusions, and said prong contacts being bent 90° in the same direction at said end of said protrusions.

8. The plug connector according to claim 1, wherein said socket housing has an end surface remote from said plug contact side, and including a sealing plate on said end surface through which said electrical lines for said contacts are guided.

9. The plug connector according to claim 1, wherein said socket housing has an interior with an encompassing wall, said cover cap has walls with an end surface having an extension, and including a sealing ring disposed in said end-surface extension, said sealing ring being disposed between said annular wall of said prong strip housing and said encompassing wall.

10. The plug connector according to claim 1, wherein said prong contacts are guided water-tightly through said prong strip housing.

11. The plug connector according to claim 1, including a sealing ring disposed in an annular encompassing groove formed in said prong strip housing.

12. The plug connector according to claim 1, including a lid having openings formed therein, said socket housing having detent hooks cooperating with said openings in said lid for permitting a first snapping-on and a second snapping-on rotated through 180° of said lid onto said socket housing.

* * * * *